United States Patent [19]

Seon et al.

[11] Patent Number: 4,636,353

[45] Date of Patent: Jan. 13, 1987

[54] NOVEL NEODYMIUM/IRON ALLOYS

[75] Inventors: Francoise Seon, Montreuil; Bernard Boudot, Paris, both of France

[73] Assignee: Rhone-Poulenc Specialites Chimiques, Courbevoie, France

[21] Appl. No.: 745,828

[22] Filed: Jun. 18, 1985

Related U.S. Application Data

[63] Continuation of Ser. No. 627,829, Jul. 5, 1984, abandoned.

[30] Foreign Application Priority Data

Jul. 5, 1983 [FR] France ..... 83 11139
Sep. 9, 1983 [FR] France ..... 83 14392

[51] Int. Cl.[4] ..... C22C 28/00
[52] U.S. Cl. ..... 420/416
[58] Field of Search ..... 420/416; 75/123 E; 148/101, 31.55, 31.57

[56] References Cited

U.S. PATENT DOCUMENTS 1,648,954 11/1927 Marden ..... 75/84.1 R
3,186,834 6/1965 Schecter et al. ..... 75/84.5
3,295,963 1/1967 Galvin et al. ..... 420/416
4,378,259 3/1983 Clark et al. ..... 148/100

FOREIGN PATENT DOCUMENTS 329884 6/1976 Austria .
5976 3/1978 Japan ..... 420/416

OTHER PUBLICATIONS

Struat, K. et al, "Magnetic Properties of Rare—Earth—Iron Intermetallic Compounds", *IEEE Transactions on Magnetics*, vol. 2, No. 3, Sep. 1966, pp. 489–493.
"Thermodynamics of the Aluminothermal Reduction of Scandium, Yttrium, and Neodymium from Fluorides", *Chem. Abstract*, vol. 95, 1981, p. 463, #157685m.
"Kinetics of the Reduction of Cerium and Neodymium from Chlorides by Calcium", Chem. Abstract, vol. 93, 1980, p. 379, #226435c.
"Kinetics of Aluminothermal Reduction of Neodymium from Fluoride", Chem. Abstract, vol. 94, 1981, p. 213, #195573k.

*Primary Examiner*—Christopher W. Brody
*Attorney, Agent, or Firm*—Burns, Doane, Swecker & Mathis

[57] ABSTRACT

Novel alloys comprising neodymium, iron and optionally another rare earth metal are facilely prepared by reducing a neodymium/rare earth halide with a reducing metal, in the presence of iron.

8 Claims, No Drawings

NOVEL NEODYMIUM/IRON ALLOYS

This application is a continuation of application Ser. No. 627,829, filed July 5, 1984 now abandoned.

BACKGROUND OF THE INVENTION

1. Field of the Invention

The present invention relates to novel alloys of neodymium and to a process for the preparation thereof.

2. Description of the Prior Art

Among the ceric rare earths, a designation including lanthanum, cerium, praseodymium and neodymium, the latter is the only metal that cannot be produced industrially by the electrolysis of its salts. In fact, in T. Kurita, Denki Kagaku, 35(7), 496–501 (1967), it is noted that yields of only 6 to 20% of pure neodymium may be obtained by electrolysis, in a molten bath, of neodymium chloride and potassium chloride.

Consequently, obtaining neodymium alloys from metallic neodymium would not appear to be an industrially feasible method.

SUMMARY OF THE INVENTION

Accordingly, a major object of the present invention is the provision of novel alloys of neodymium by a novel process well adapted for industrial application.

Briefly, the present invention features novel neodymium alloys comprising both neodymium and iron.

In one specific embodiment of the invention, the subject neodymium alloys are comprised of neodymium, iron and at least one additional rare earth metal selected from among yttrium, lanthanum, cerium, praseodymium, gadolinium, terbium, dysprosium, holmium, erbium, thulium and lutetium.

The rare earth metal comprising the subject alloys is thus any of the metals belonging to the group constituted by yttrium and the lantanides, except samarium, europium and ytterbium.

DETAILED DESCRIPTION OF THE INVENTION

More particularly according to the present invention, in the description which follows the designation "RE metal" is intended to denote a rare earth metal or a mixture of rare earth metals selected from that group constituted as above outlined.

The present invention also features a process for the production of the subject alloys, comprising reducing a neodymium halide and optionally a halide of RE metal, with a reducing metal, in the presence of iron.

As the neodymium halide, neodymium fluoride or chloride, or mixtures thereof, is advantageously used in the process according to the invention.

Preferably, neodymium fluoride is used.

It is desirable that the halide used by highly pure, i.e., free of residual oxides and oxyhalides and that it be dry: its water content should be less than 5% and preferably less than 2%.

Neodymium fluoride is available in the anhydrous state, as it is only slightly hygroscopic.

In contrast, neodymium chloride exists in the form of hydrates containing 6 to 7 moles of water per mole of neodymium chloride. It is typically prepared by reacting hydrochloric acid with neodymium sesquioxide.

Utilization of this particular chloride requires a drying stage at a temperature ranging from 100° C. to 500° C., but preferably ranging from 200° C. to 250° C. The drying operation may be carried out in air or under reduced pressure, for example, between 1 mm of mercury (=133.332 Pa) and 100 mm of mercury (=13 332.2 Pa). This treatment is also applicable to neodymium fluoride.

The duration of the drying treatment may vary from 2 to 24 hours.

The conditions noted immediately above for the drying of the neodymium halides are not critical, but are preferable.

The size of the neodymium halide particles may vary. They are commercially available in powder form having particle sizes ranging from 40 to 150 μm. There is no lower limit as regards the aforesaid particle sizes.

For the RE metal halide, an RE metal fluoride, an RE metal chloride, or a mixture thereof, is advantageously selected.

Preferably, an RE metal fluoride is used.

The properties and conditions of use of the RE metal halide are identical to those set forth with respect to the neodymium halide.

In view of the above, it is possible to employ a mixture of the halides of different rare earth metals.

The reducing metal employed in the process of the invention may comprise an alkali metal, an alkaline earth metal, or mixture thereof. As the alkali metal, sodium, lithium and potassium are representative, and, as the alkaline earth metal, calcium or magnesium are also representative.

Preferably, calcium or magnesium is used, and even more preferably calcium is used.

The reducing metal is used in the form in which it is commercially available, either in mass form, or as granules or pebbles.

Concerning the iron which forms an alloy with neodymium, it provides an alloy which melts at a low temperature, and which makes the process industrially attractive.

It is used in commercially available form, as a powder or as flakes.

A preferred embodiment of the process of the invention comprises adding calcium chloride or calcium fluoride, depending upon the other parameters, to the reaction medium, to lower the melting point and the density of the slag formed during the reaction, such that the neodymium-iron alloy formed will separate more easily.

As the objective is to obtain a $CaF_2$—$CaCl_2$ slag, when the neodymium source is neodymium fluoride or neodymium chloride, calcium chloride or calcium fluoride is respectively added. If the neodymium halide is a mixture of fluoride and chloride, a mixture of calcium fluoride and chloride is added in order to obtain a $CaF_2$—$CaCl_2$ mixture having a composition more fully discussed hereinbelow.

In the event that a halide of an RE metal is present, calcium chloride should be added when neodymium fluoride is used and an RE metal fluoride and calcium fluoride, if neodymium choride and a chloride of an RE metal are used. If the neodymium halide or the halide of the RE metal is a mixture of fluoride and chloride and if the halides of neodymium and of the RE metal are different in nature, it is necessary to add a $CaF_2$—$CaCl_2$ mixture in order to obtain the desired composition.

Consistent herewith, it is possible to use commercially available calcium halides: anhydrous calcium fluoride and calcium chloride, dehydrated calcium chloride, which must be dried at from 300° C. to 400° C. under reduced pressure on the order of 1 mm of mercury (=133.322 Pa) to 100 mm of mercury (=13 332.1 Pa).

The process according to the invention comprises mixing together a neodymium halide, optionally a halide of an RE metal, a reducing metal, iron and optionally a calcium halide in the proportions given hereinbelow.

The quantity of the RE metal halide used is calculated as a function of the alloy composition desired. It is preferably such amount that the RE metal constitutes 0 to 50% by weight of the mixture of the neodymium and the RE metal, preferably 0 to 10%. The amount of the reducing metal may vary over wide limits. However, it is desirable to employ a quantity sufficient to reduce the neodymium halide and optionally the RE metal halide, but it is not to be found in an appreciable amount in the final alloy. The quantity of the reducing metal is at least equal to the stoichiometric amount, possibly in slight excess thereof, e.g., up to 20% in excess of the stoichiometric amount.

The amount of iron is controlled by the desired composition of the desired final alloy. It is such that an alloy of neodymium and iron melting at the reaction temperature is obtained. It is calculated in such manner that the iron constitutes 5 to 30% by weight of the final product alloys.

The amount of the calcium halide added is adjusted such as to obtain a slag comprising 30 to 70% by weight of calcium chloride, and preferably 60 to 70% thereof.

The different neodymium, RE metal and calcium halides and the aforementioned metals constitute a "charge" having the desired composition by weight. The components of said charge may be reacted with each other in any order: by the simultaneous mixture of all of the components or by preparing premixtures, on the one hand of the neodymium and calcium halides, optionally the RE metal halides and on the other hand, of the reducing metal and the iron.

The reaction is carried out at a temperature of from 800° C. to 1100° C. The upper limit on such temperature is not critical and may be as high as 1400° C. Preferably, a temperature ranging from 900° C. to 1100° C. is used.

The reaction is conducted under atmospheric pressure, but in an inert gas atmosphere. For this reason, air is excluded by reducing the pressure to a noncritical value, for example, from 1 mm of mercury (=133.322 Pa) to 100 mm of mercury (=13 332.2 Pa), followed by flushing with inert gases, in particular argon. It is desirable to subject the rare gas to dehydrating and deoxygenating treatment by conventional methods, for example, by passage through a molecular sieve.

The inert atmosphere is maintained throughout the reduction.

The duration of the reaction is a function of the capacity of the apparatus and its ability to be heated rapidly to reaction temperature. Generally, once the desired temperature is attained, it is maintained for a period of time of from approximately 30 minutes to 3 hours.

During heating, two phases are formed in the reaction medium: a metallic phase comprising the neodymium-iron alloy, upon which a slag comprising $CaF_2$—$CaCl_2$ is floating; it has a density less than that of the alloy.

Upon completion of the aforesaid time period, the heating is discontinued.

The alloy may be separated immediately from the slag by hot pouring or it may be allowed to cool under an inert gas atmosphere (to ambient temperature 15° to 25° C.), such that the alloy solidifies and may be stripped.

It is found that the yield of neodymium in the alloy, expressed with respect to the neodymium contained in the halide, varies from 80 to 96%.

In the case wherein the metallic phase also contains another rare earth metal, the yield in rare earth metals (neodymium+RE metal), expressed with respect to the rare earth metals contained in the halides employed, varies from 75 to 95%.

The process of the invention may be carried out in apparatus of conventional type, widely used in the field of metallurgy.

The reaction is conducted in a crucible placed in a reactor made of a material that is resistant to hydrofluoric and hydrochloric acid vapors.

It may comprise a heat resistant stainless steel, for example, a steel containing 25% chromium and 20% nickel, but preferably of Inconel, which is an alloy containing nickel, chromium (20%), iron (5%) and molybdenum (8-10%).

The reactor is equipped with temperature control means (for example, a thermocouple) and an inert gas inlet and outlet. It is provided at its upper extremity with a double envelope wherein a cooling liquid is circulating.

The reactor is placed in an induction furnace or a furnace heated by electric resistance.

A crucible into which the temperature control device is immersed, is placed at the bottom of the reactor. It must be fabricated from a material resistant to neodymium halides or have a lining that is resistant thereto. Preferably, a tantalum crucible is used.

Once the reaction is completed, the molten alloy may be cooled into ingots, for example, by casting.

The alloys obtained according to the present invention have the following composition by weight:

(i) 70 to 95% neodymium; and (ii) 5 to 30% iron.

The presence of a very small amount of the reducing metal, varying from 0 to 3% by weight, is observed.

According to the present invention, alloys having the following composition by weight may also be obtained:

(i) 70 to 95% of a mixture of neodymium and RE metal; and (ii) 5 to 30% iron.

In the mixture of neodymium and the RE metal, the proportion of the RE metal may represent 0 to 50% by weight of the mixture of neodymium and the RE metal and preferably 0 to 10%.

The presence of a very small amount of the reducing metal, from 0 to 3% by weight, is again noted.

Preferred compositions of the alloys obtained are given below as exemplary:

(1) neodymium-iron alloy:

(i) 83 to 91% neodymium;

(ii) 9 to 16% iron; and (iii) 0 to 1% calcium;

(2) neodymium-iron-RE metal alloy:

(i) 83 to 91% of a mixture of neodymium and RE metal;

(ii) 9 to 16% iron; and (iii) 0 to 3% calcium.

The alloys obtained according to the present invention are very high in neodymium content, containing up to 95% of the metal.

They may be used as master alloys, in particular in the manufacture of permanent magnets.

Prior to setting forth specific examples illustrating the more practical embodiments of the invention, the methods used for the determination of the different components of the alloys by the following processes are summarized briefly:

(A) neodymium and the other rare earth metal when present, are determined together by the chemical method described below, and separately by x-ray fluorescence. The chemical method of determination consists of:

(i) dissolving the alloy sample in an acid medium;
(ii) heating the resulting solution to boiling;
(iii) precipitating the reducing metal, iron and the rare earths in the form of their hydroxides, at pH 9, by an ammonia treatment, then filtering and washing the precipitates obtained;
(iv) redissolving the rare earth hydroxide precipitate in an acid medium;
(v) adding ammonium oxalate to the solution obtained at boiling in order to obtain rare earth oxalates;
(vi) calcining the rare earth oxalates at 900° C. for one hour to convert same to their oxides;
(vii) weighing the amount of oxides obtained to be able to calculate the amount of rare earths contained in the alloy;

(B) the other metals, the reducing metal and the iron are titrated by atomic absorption.

In order to further illustrate the present invention and the advantages thereof, the following specific examples are given, it being understood that same are intended only as illustrative and in nowise limitative. In said examples to follow, one illustrates the preparation of a neodymium-iron alloy (Example 1) and two illustrate the preparation of neodymium-praseodymium-iron alloys (Examples 2 and 3).

EXAMPLE 1

Preparation of a noedymium-iron alloy containing 12% iron

First, 382.2 g calcium chloride were coarsely ground and then dried at a temperature of 350°–400° C., under a reduced pressure of 1 mm of mercury (=133.322 Pa).

Subsequently, a premixture containing 382.2 g calcium chloride in the dry state and 281.4 g neodymium fluoride having an average particle diameter of 60 μm, was prepared. The drying of said mixture was carried out for 24 hours in a vacuum furnace at 225° C., under a reduced pressure of 1 mm of mercury (=133.322 Pa). This charge was then ready for use.

The calciothermal reduction of the neodymium fluoride was carried out in a tantalum crucible with a capacity of approximately one liter, placed at the bottom of the reactor, made of Iconel and equipped with an argon inlet and outlet and a thermocouple was immersed in the reaction medium contained in the crucible: the upper end of the crucible was provided with a double envelope in which cold water was circulating (approx. 10° C.).

The proportion of the components of the charge was such that the conditions specified below were satisfied:

(i) that an alloy containing 12% iron was obtained;
(ii) that there was an excess in calcium of 20% with respect to the stoichiometric weight required; and
(iii) that a slag containing 70% calcium choride was formed.

Successively, at the bottom of the crucible, 27.5 g iron were introduced in the form of chips, followed by 101 g calcium in the form of granules and the aforesaid charge containing 382.2 g calcium chloride and 281.4 g neodymium fluoride.

Once the crucible was replaced in the reactor, it was closed, the pressure was reduced to approximately 100 mm of mercury (=13 332.2 Pa) to remove the air and a flow of argon was established, which was maintained throughout the reaction.

Simultaneously, the temperature was raised until the specific temperature of 1100° C. was attained, this temperature was maintained for 30 min.

562 g of the slag were collected and 188 g of a neodymium-iron alloy were recovered by hot pouring into a cast iron ingot mold. The yield of neodymium in the alloy, expressed with respect to the neodymium contained in the neodymium fluoride, was 81%.

The analysis of the alloy obtained was as follows:

(i) 87.4% neodymium;
(ii) 12% iron; and
(iii) 0.6% calcium.

EXAMPLE 2

Preparation of a neodymium-praseodymium-iron alloy containing 13% iron

First, 530.8 g calcium chloride were coarsely ground, then dried for 3 hours at a temperature of 350°–400° C. and under a reduced pressure of 1 mm of mercury (=133.32 Pa).

Subsequently, a premixture was prepared containing 530.8 g calcium chloride in the dry state and 390.8 g of a mixture containing 96.4% neodymium fluoride and 3.6% praseodymium fluoride, said mixture having an average particle diameter of 60 μm. The mixture was dried for 24 hours in a vacuum furnace at a temperature of 225° C., under a reduced pressure of 1 mm of mercury (=133.322 Pa). The aforesaid charge was then ready for use.

The calciothermal reduction of neodymium and praseodymium fluoride was carried out in a one liter tantalum crucible placed at the bottom of a reactor made of Iconel, which was equipped with an argon inlet and outlet and a thermocouple in a thermometric tube immersed in the reaction medium contained in the crucible: the upper end of the reactor was provided with a double envelope in which cold water (appro. 10° C.) was circulating.

The proportion of the components of the charge was such that the conditions specified below were satisfied:

(i) that an alloy containing 13% iron was obtained;
(ii) that there was an excess in calcium of 20% with respect to the stoichiometric weight required; and
(iii) that a slag containing 70% calcium chloride was formed.

The following materials were successively introduced at the bottom of the crucible: 38.2 g iron in the form of chips, 140.3 g calcium in the form of granules and the precipitated charge containing 530.8 g of calcium chloride and 390.8 g of a mixture of neodymium and praseodymium fluoride.

Once the crucible was replaced in the reactor, it was closed, the pressure reduced to approximately 100 mm of mercury (=13 332.2 Pa) to exhaust the air, whereupon a flow of dry argon was established, which was maintained throughout the reaction.

Simultaneously, the temperature was raised until a temperature of 1100° C. was attained; this temperature was maintained constant for 30 min.

717.2 g of the slag were collected and 296 g of a neodymium-praseodymium-iron alloy were recovered by hot pouring into a cast iron ingot mold. The yield of rare earths in the alloy, expressed with respect to the rare earths contained in the neodymium and praseodymium fluorides, was 90%.

The analysis of the alloy obtained was as follows:

(i) 86% of a mixture containing 96.4% neodymium and 3.6% praseodymium;

(ii) 13% iron; and (iii) 1% calcium.

EXAMPLE 3

Preparation of a neodymium-praseodymium-iron alloy containing 13% iron

Example 2 was repeated, except that in place of the mixture of neodymium fluoride and praseodymium fluoride, a mixture containing 58% neodymium chloride and 42% praseodymium chloride was used. In this case, the neodymium and praseodymium chlorides were dried for 3 hours in a vacuum furnace at a temperature of 220° C., under a reduced pressure of 1 mm of mercury (=133.332 Pa).

The charge employed, in the same mode of operation, was the following:

(i) 39.3 g iron;

(ii) 144 g calcium;

(iii) 142.7 g calcium fluoride; and (iv) 498.6 g of a mixture of neodymium and praseodymium chlorides.

Upon completion of the reaction, 519 g of a slag and 275 g of a neodymium-praseodymium-iron alloy were obtained, corresponding to a rare earth yield of 81%.

The alloy contained:

(i) 84% of a mixture containing 58% neodymium and 42% praseodymium;

(ii) 13% iron; and (iii) 3% calcium.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A neodymium-based metal alloy which comprises from about 70 to 95% by weight of metallic neodymium and from about 5 to 30% by weight of metallic iron.

2. A neodymium-based metal alloy which comprises from about 70 to 95% by weight of admixture of metallic neodymium with at least one of the rare earth metals ytrrium, lanthanum, cerium, praseodymium, gadolinium, terbium, dysprosium, holmium, erbium, thulium and lutetium, at least 50% of said admixture comprising metallic neodymium, and from about 5 to 30% by weight of metallic iron.

3. The neodymium-based metal alloy as defined by claim 2, said admixture comprising up to 10% of said at least one rare earth metal.

4. The neodymium-based metal alloy as defined by claims 1 or 2, further comprising up to 3% by weight of an alkali or alkaline earth metal.

5. The neodymium-based metal alloy as defined by claim 2, said at least one rare earth metal comprising praseodymium.

6. The neodymium-based metal alloy as defined by claim 1, which comprises from about 83 to 91% by weight of metallic neodymium and from about 9 to 16% by weight of metallic iron.

7. The neodymium-based metal alloy as defined by claim 2, which comprises from about 83 to 91% by weight of said admixture and from about 9 to 16% by weight of metallic iron.

8. The neodymium-based metal alloy as defined by claim 4, said alkali or alkaline earth metal comprising calcium.

* * * * *